US007036780B1

(12) United States Patent
Geninatti

(10) Patent No.: US 7,036,780 B1
(45) Date of Patent: May 2, 2006

(54) ROCK-CLIMBING MACHINERY

(76) Inventor: Marilyn Geninatti, 5502 E. Palo Verde Dr., Paradise Valley, AZ (US) 85253

( * ) Notice: Subject to any disclaimer, the term of this patent is extended or adjusted under 35 U.S.C. 154(b) by 0 days.

(21) Appl. No.: 10/796,869

(22) Filed: Mar. 8, 2004

(51) Int. Cl.
*A63B 27/00* (2006.01)

(52) U.S. Cl. ..... 248/231.9; 248/925; 114/230.1

(58) Field of Classification Search ..... 248/925, 248/231.9, 231.91, 229.2, 229.21, 229.23; 294/19.1, 24; 114/230.1, 230.15, 230.18, 114/230.3
See application file for complete search history.

(56) References Cited

U.S. PATENT DOCUMENTS

| | | | | | |
|---|---|---|---|---|---|
| 149,575 | A | | 4/1874 | Clendaniel et al. | 294/19.1 |
| 1,158,247 | A | * | 10/1915 | Lindblom | 248/509 |
| 1,536,701 | A | | 5/1925 | Buckingham et al. | 114/230.25 |
| 1,852,629 | A | | 4/1932 | Sturges | 114/230.15 |
| 2,116,880 | A | | 5/1938 | Dee | 114/221 R |
| 2,979,013 | A | | 4/1961 | Whittall | 114/221 R |
| 3,098,462 | A | | 7/1963 | Holzman | 114/221 R |
| 3,913,515 | A | | 10/1975 | Hernsjo et al. | 114/221 R |
| 4,793,646 | A | | 12/1988 | Michaud, Jr. | 294/19.1 |
| 4,811,467 | A | * | 3/1989 | Lowe | 24/592.1 |
| 4,817,551 | A | * | 4/1989 | Matson | 114/230.15 |
| 4,986,207 | A | | 1/1991 | Reed | 114/221 R |
| 5,005,266 | A | * | 4/1991 | Fister et al. | 24/601.5 |
| 5,116,260 | A | | 5/1992 | Upchurch | 114/221 R |
| 5,307,753 | A | * | 5/1994 | Besonen et al. | 114/230.18 |
| 5,454,611 | A | | 10/1995 | Wanat | 294/24 |
| 5,622,399 | A | | 4/1997 | Albright | 294/24 |
| 5,704,669 | A | * | 1/1998 | Clark | 294/19.1 |
| 5,752,731 | A | * | 5/1998 | Crone | 294/24 |
| 5,878,834 | A | * | 3/1999 | Brainerd et al. | 182/3 |
| 6,022,059 | A | | 2/2000 | Regamey | 294/24 |
| 6,409,240 | B1 | | 6/2002 | Ferguson | 294/19.1 |
| 6,510,599 | B1 | * | 1/2003 | AmRhein | 29/426.1 |
| 6,678,993 | B1 | * | 1/2004 | Long | 43/42.72 |
| 6,776,317 | B1 | * | 8/2004 | Parker | 224/251 |

* cited by examiner

*Primary Examiner*—Anita M. King
(74) *Attorney, Agent, or Firm*—Ellis & Venable, P.C.; Lance C. Venable

(57) ABSTRACT

A rock-climbing device that safely aids climbers during a climb is described. The rock-climbing device has two carabiners attached to a band which runs through a hollow tube. The climber is able to manually extend the tube over his or her head to an out of reach fixed anchor in the wall of the rock and safely attach the carabiner at the end of the device. This allows the climber to then attach the bottom carabiner of the rock-climbing device to his or her harness via a rope on the harness. The rock-climbing device allows the climber to safely and easily advance up the rock.

12 Claims, 5 Drawing Sheets

ROCK-CLIMBING MACHINERY

FIELD OF THE INVENTION

The present invention relates generally to an apparatus used for extending the reach of a person and, more particularly, to an apparatus used by rock climbers for extending the reach of a climbing safety device.

BACKGROUND OF THE INVENTION

Rock climbing is a dangerous and challenging sport. Individuals involved in the sport are continuously searching for ways to make the sport easier and safer. One such safety device employed by rock climbers is known as a Quick-Draw. A Quick-Draw is a device that consists of two carabiners connected by a sling. When climbing, one of the carabiners is fastened to the climber's harness and the other is latched to a fixed anchor attached to the rock This configuration of the Quick-Draw device helps prevent the climber from falling by being attached to the rock.

The present invention serves to arrest, or stop the climber from falling should he or she fall or "come off" the rock. The top carabiner is clipped to a fixed anchor, which is already in the rock. The lower carabiner clips the rope that is connected to the climber. The disadvantage of the traditional Quick-Draw device is that one must be able to reach the fixed anchor to clip it. Extended reaches occur when fixed anchors are widely spaced, when climbers are short, or when the technical grade of the climb is at the limit of the climber. To do this, the climber must reach up to the fixed anchor making it more likely for a fall to occur.

In contrast to the traditional Quick-Draw, the present invention is capable of allowing the rock climber to reach an out-of-reach fixed anchor from a lower position. Additionally, the present invention is lightweight and has a small structure allowing a rock climber to carry it easily as part of his or her equipment.

A current device used to aid rock climbers in attaching carabiners to out of reach fixed anchors can be found in U.S. Pat. No. 6,510,599 (AmRhein). Other information relevant to address the problem of attaching out of reach fixed anchors in general can be found in U.S. Pat. No. 6,409,240 (Ferguson), U.S. Pat. No. 3,913,515 (Hernsjo et al.), U.S. Pat. No. 4,793,646 (Michaud, Jr.), U.S. Pat. No. 6,022,059 (Regamey), U.S. Pat. No. 5,622,399 (Albright), U.S. Pat. No. 5,454,611 (Wanat), U.S. Pat. No. 5,116,260 (Upchurch), U.S. Pat. No. 4,986,207 (Reed), 3,098,462 (Holzman), U.S. Pat. No. 2,979,013 (Whittall), U.S. Pat. No. 2,116,880 (Lee), U.S. Pat. No. 1,852,629 (Sturges), U.S. Pat. No. 1,536,701 (Buckingham et al.), and U.S. Pat. No. 149,575 (Clendaniel et al.). It is understood that the term "fixed anchor" encompasses any device that is secured to a rock or the like.

However, each of these devices suffers from one or more of the following disadvantages. First, none provide protection from falling. These devices are designed to extend an individual's reach, but they do not have a mechanism to attach a safety harness. Second, none of the devices are of a type that can be easily carried on a climb. When on a climb, the climber must be able to easily carry all necessary equipment. Any equipment that is heavy or cumbersome is not ideal.

Presently, there is no rock-climbing device that can aid climbers in grasping out-of-reach fixed anchors that also protects climbers from falls and is easy to carry. For the foregoing reasons, a device that would allow rock climbers to easily attach carabiners to fixed anchors that are out of reach and to a harness is necessary for safety and ease. It is also understood that the term "carabiner" encompasses the traditional definition of carabiner as defined in the figures herein, as well as any generally "hook" shaped device that can be secured to a fixed anchor as defined herein.

SUMMARY OF THE INVENTION

It is an object of the present invention to provide a rock-climbing device that safely allows climbers to access out of reach fixed anchors along a climbing path.

It is a further object of the present invention to provide a rock-climbing device that is easily carried as part of a rock climber's equipment.

It is a further object of the present invention to provide a rock-climbing device that comes in various sizes so that it can easily accommodate climbers of different heights.

It is a further object of the present invention to provide a rock-climbing device that attaches to a climber's safety harness.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C 0112, paragraph 6 to define the invention. To the contrary, if the provisions of 35 U.S.C §112, paragraph 6 are sought to be invoked to define the invention(s), the claims will specifically state the phrases "means for" or "step for" and a function, without also reciting in such phrases any structure, material, or act in support of the function.

Moreover, even if the provisions of 35 U.S.C §112, paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later developed equivalent structures, materials, or acts for performing the claimed function.

DESCRIPTION OF PREFERRED EMBODIMENTS

Figure 1:
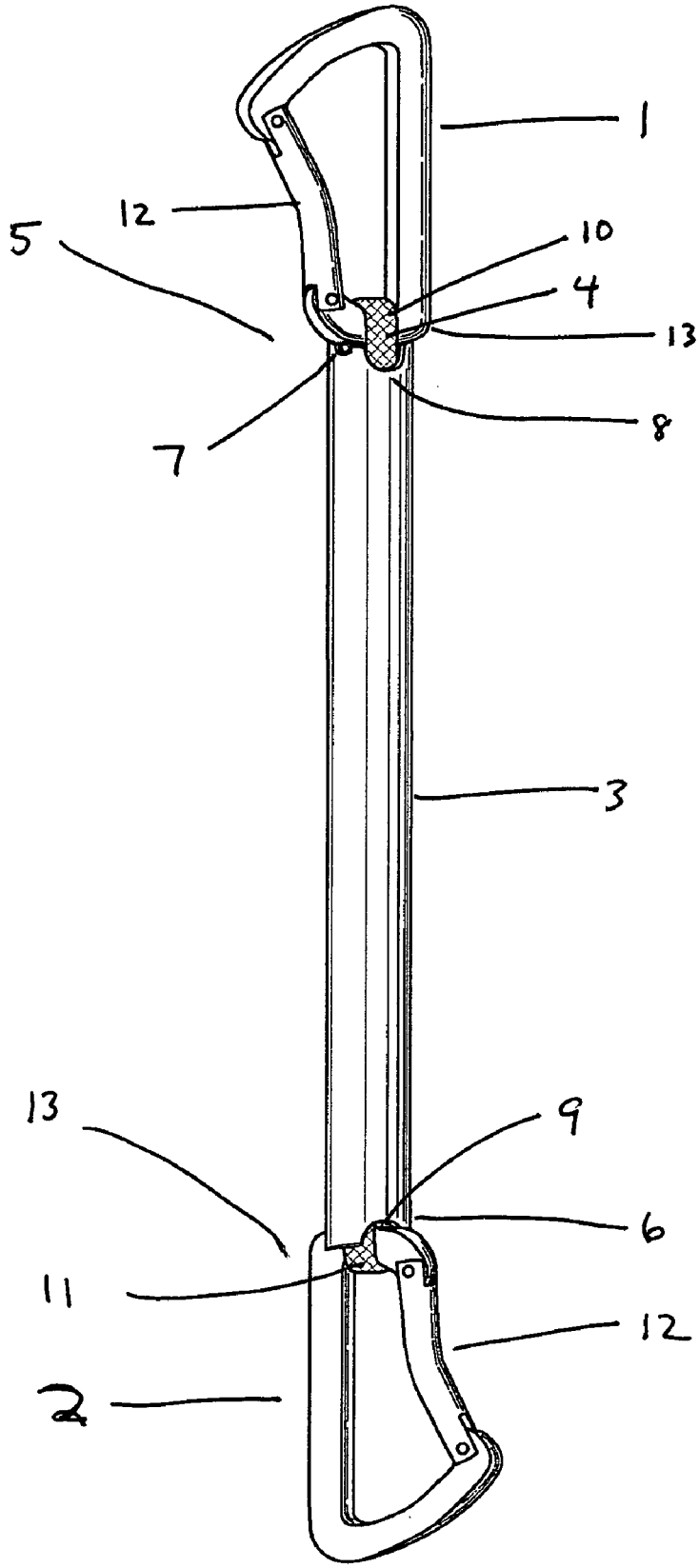
FIG. 1 shows a perspective view of the preferred rock-climbing device.
Figure 5:
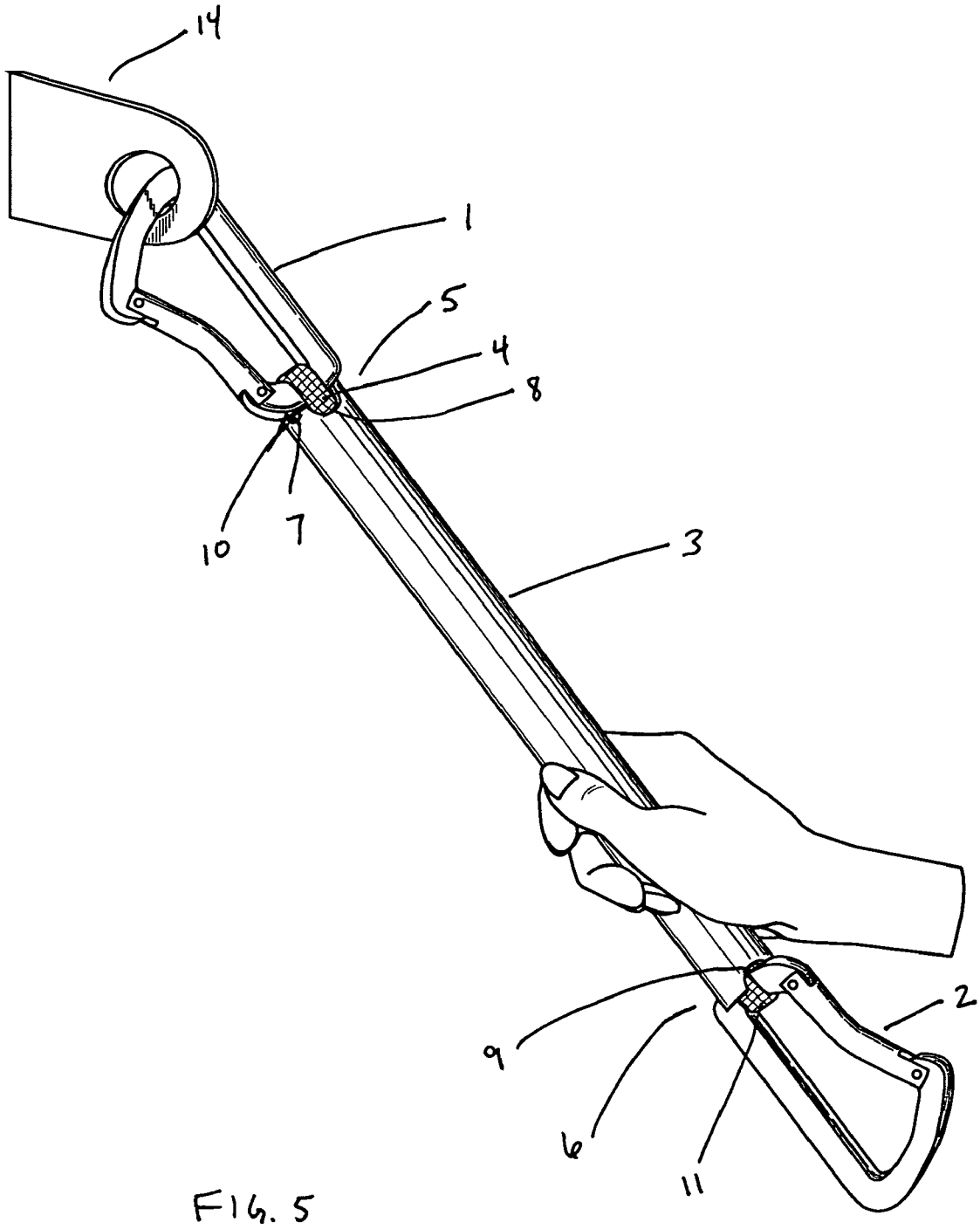
FIG. 5 shows the rock-climbing device being used by a climber to attach the first carabiner to an out-of-reach fixed anchor.

The preferred embodiment of the invention for the rock-climbing device that safely aids climbers during a climb is shown in the drawings. The rock-climbing device is typically hung from the climber's harness before starting the climb. The carabiner 2 at the bottom 6 of the device is clipped to the climber's rope, and the top, stiffly secured carabiner 1 is engaged in a rigid position on the top 5 end of the device. When the climber reaches a position where he or she is secure, but moving forward could jeopardize the climber's safety, the device is removed from the harness. The climber uses the device to reach over his or her head to reach the next fixed anchor attached to the rock as shown in FIG. 5. Once the carabiner 1 is attached to the fixed anchor, the climber brings the rope on his or her harness up to the bottom carabiner 2 and clips it to the carabiner 2. This connects the climber's harness directly to the fixed anchor in the wall of the rock As shown in FIG. 1, the preferred embodiment of the invention includes two carabiners 1 and 2, a hollow tube 3, and a durable, slightly elastic band 4. It is preferred that the carabiners 1 and 2 are made of lightweight aluminum with a spring loaded lever 12 in order to minimize weight. It is understood that the spring loaded lever 12 in the preferred embodiment is curved or bent. However, the lever 12 may also encompass a straight lever as well. In their normal static position, the carabiners 1 and 2 remain securely closed. To open the spring loaded lever 12 of the carabiner 1 or 2, a climber must apply pressure to it, causing the spring to retract, thereby opening the spring loaded lever 12. Additionally, in the preferred embodiment, the durable, slightly elastic band 4 is made of a material that becomes taut when stretched or twisted, such as nylon or Spectra®. Moreover, the hollow tube 3 is preferably a lightweight rigid hollow pipe made of plastic, PVC, or carbon fiber. It must be rigid so as to hold the carabiners 1 and 2 in a rigid position ready to be opened and clipped to a fixed anchor in the rock wall, but light enough to be easily carried during a climb.

Figure 2:
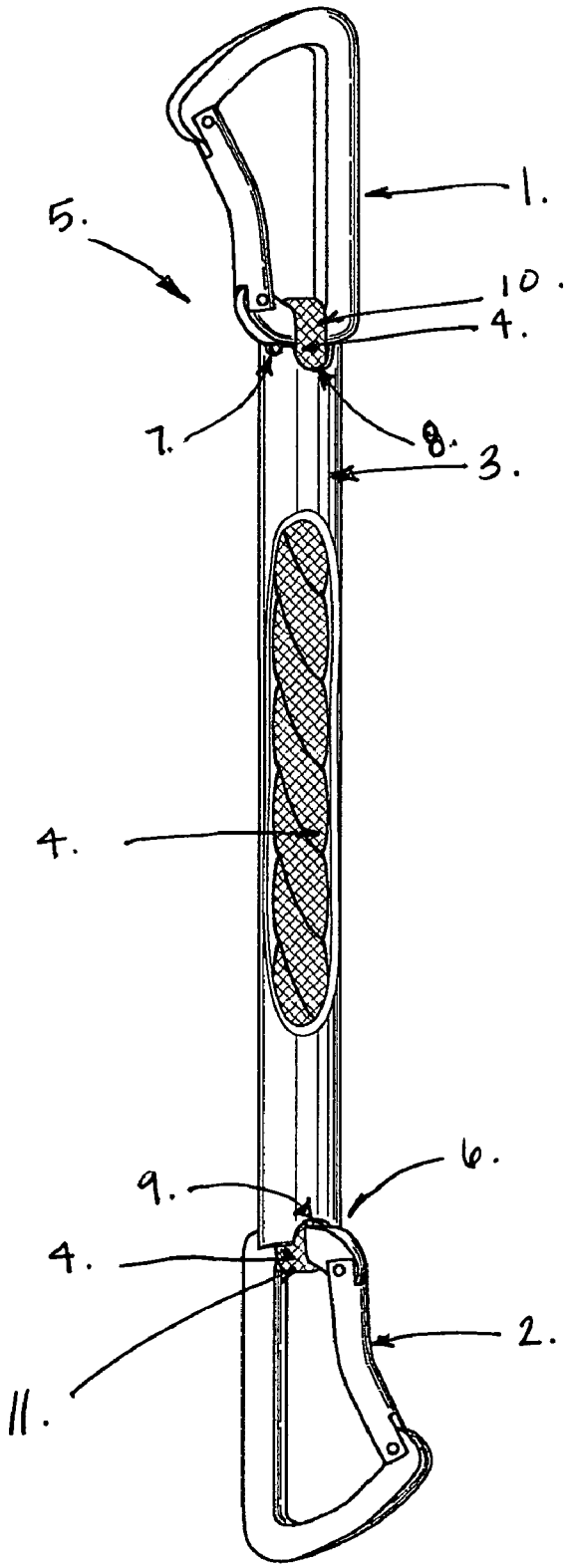
FIG. 2 shows a cross sectional view of the preferred rock-climbing device with the band passing through the shaft.

Further, as illustrated by FIG. 2, the tube 3 has a hollow shaft through which the durable, slightly elastic band 4 passes. Moreover, the carabiners 1 and 2 are attached to the first end 10 of the band 4 and the second end 11 of the band 4, respectively. Each end of the band 4 is looped around the bottom 13 of the carabiners 1 and 2 and is securely in place when the spring loaded lever 12 is in the closed position. In the preferred embodiment, the band 4 can either be looped at each end and fastened around the carabiner 1 and 2, or it can be one continuous loop.

Figure 3A:
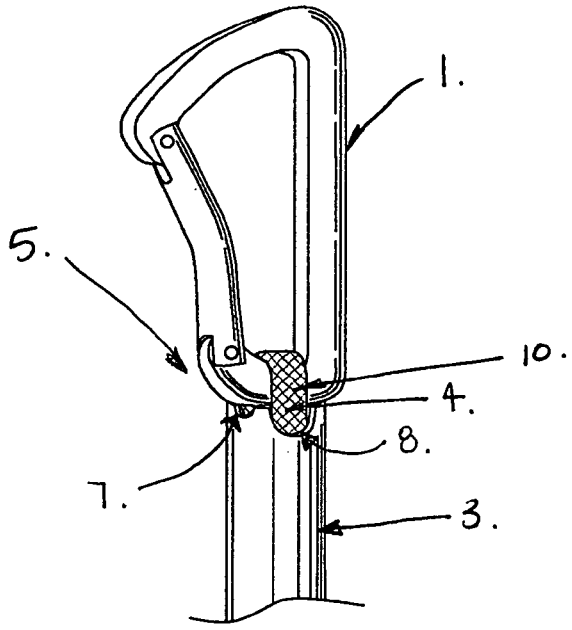
FIG. 3A shows a sectional view of the top of the rock-climbing device with the carabiner resting in the stiffly engaged position.
Figure 3B:
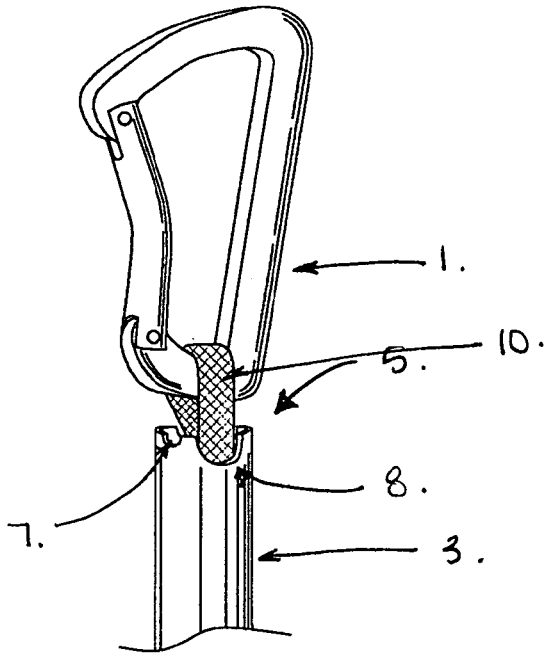
FIG. 3B shows a sectional view of the top of the rock-climbing device with the carabiner lifted off of the tube.

In addition, the tube 3 has a top 5 with a first pair of notches 7 and a second pair of notches 8 as shown in FIGS. 3A and 3B. The first pair of notches 7 is located approximately 1800 from each other as is the second pair of notches 8 on the top 5 of the tube 3. In the preferred embodiment, the first pair of notches 7 should be cut to a depth that will hold the first carabiner 1 in a rigid position when the band 4 is tightly stretched as shown in FIG. 3A This depth will depend on the length of the band 4 and of the tube 3 and will be less than the depth of the second pair of notches 8. Alternatively, the second pair of notches 8 holds the first carabiner 1 when it is loose and not in position to attach to an out-of-reach fixed anchor 14 in the rock wall. The depth of the second pair of notches 8 also depends on the length of the band 4 and of the tube 3 and, as discussed above, should be greater than the depth of the first pair of notches 7.

The first carabiner 1 is alternated between the rigid position and loose position by pulling up on the first carabiner 1 and the slightly elastic band 4 as shown in FIG. 3B. The band 4 is then rotated or twisted to either allow the first carabiner 1 to rest in the first pair of notches 7 or the second pair of notches 8. The band 4 has an effective length which is defined as the length of the band 4 between the first and second carabiners 1 and 2. The radial twisting of the band 4 makes the effective length of the band 4 shorter, and therefore, taut. As described above, the first carabiner 1 is in the rigid position when resting in the first pair of notches 7 and in the loose position when resting in the second pair of notches 8.

The first pair of notches 7 holding the first carabiner 1 in a rigid position is a significant advantage of the embodiment of the invention because it allows the first carabiner 1 to be in a position where it is easily attached to an out-of-reach fixed anchor 14 in the wall of a rock as shown in FIG. 5. To attach the first carabiner 1 to the out-of-reach fixed anchor 14 in the rock wall, the climber extends the tube 3 in the direction of the out-of-reach fixed anchor 14 and clips the first carabiner 1 to the fixed anchor in the wall. The climber then can attach the second carabiner 2 to his or her safety harness. This is done safely from a position lower than the fixed anchor in the wall and protects the climber from falling.

Figure 4A:
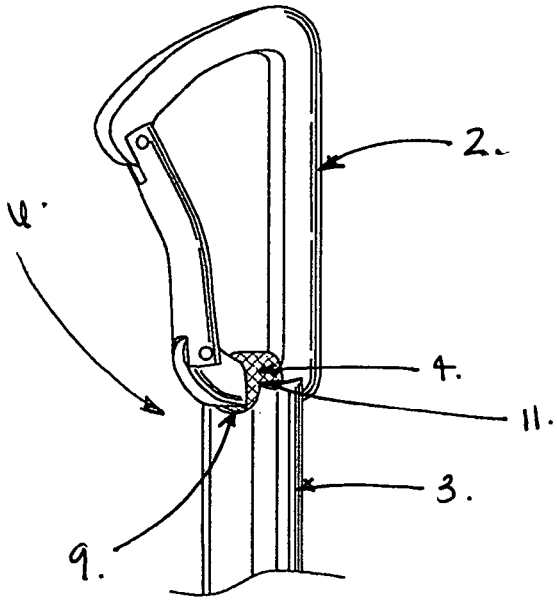
FIG. 4A shows a sectional view of the bottom of the rock-climbing device with the carabiner resting in the engaged position.
Figure 4B:
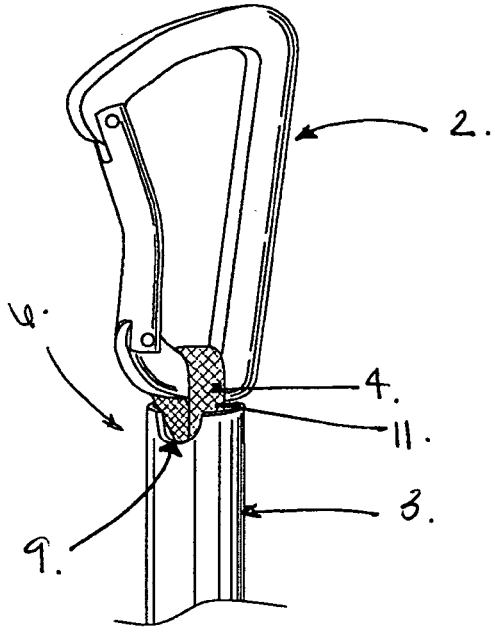
FIG. 4B shows a sectional view of the bottom of the rock-climbing device with the carabiner lifted off of the tube.

Further, as shown in FIGS. 4A and 4B, the tube 3 has a bottom 6 with a third pair of notches 9. The third pair of notches 9 is located approximately 180° apart from each other. The second carabiner 2 is held by the third pair of notches 9 when the slightly elastic band 4 is either taut or loose as shown in FIG. 4A These notches help keep the second carabiner 2 in place at the bottom 6 of the tube 3. Further, the depth of the third pair of notches 9 depends on the length of the band 4 and of the tube 3. FIG. 4B illustrates the second carabiner 2 being pulled out of the third pair of notches 9.

In an alternate embodiment of the invention, the bottom 6 of the tube 3 does not have a third pair of notches 9. In this embodiment, rather than resting in the third pair of notches 9, the second carabiner 2 rests directly on the tube 3 when the band 4 is either in the taut or loose position.

As shown in FIG. 5, the bottom 6 of the rock-climbing device is held by the rock climber when reaching over his or her head to attach the first carabiner 1 to the out-of-reach fixed anchor 14 in the rock wall. Additionally, in FIG. 5, the first and second carabiners 1 and 2 are shown in the rigid position. The person using the rock-climbing device in FIG. 5 can reach up over his or her head and use the out-of-reach fixed anchor 14 to apply pressure to the spring loaded lever on the carabiner causing it to open and fit through the out-of-reach fixed anchor 14. The rope on the climber's harness can be lifted to the second carabiner 2 and attached to it so that the entire harness is secured to the rock by the out-of-reach fixed anchor 14, the two carabiners 1 and 2, and the band 4. This provides the climber security and protection from falling.

Figure 6:
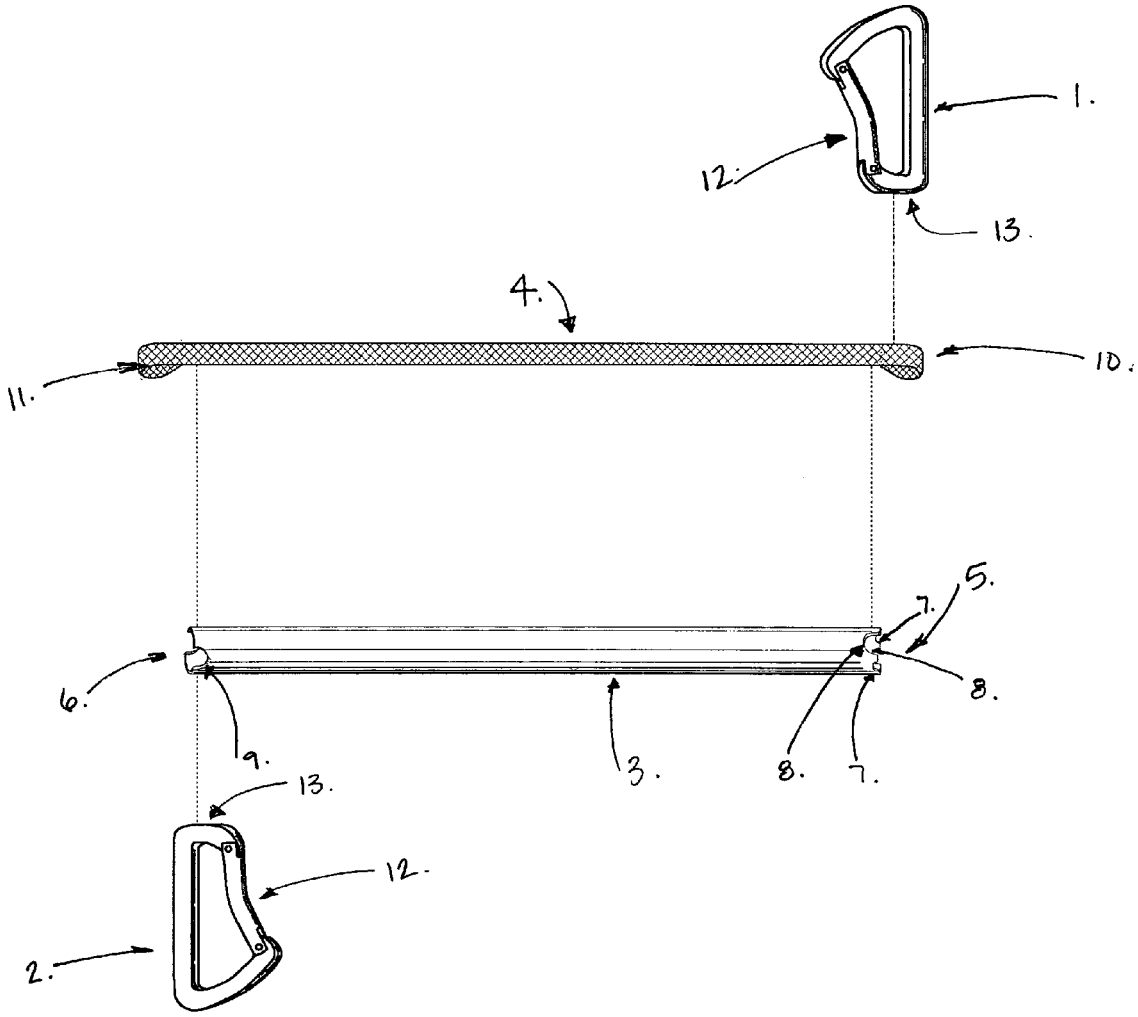
FIG. 6 shows each separate, unattached piece of the rock-climbing device.

Each separate piece of the preferred embodiment is shown in FIG. 6. These pieces attached together create the preferred rock-climbing device. Preferably, the slightly elastic band 4 is drawn through the hollow tube 3 where the first end 10 of the band 4 emerges from the top 5 of the tube 3 and the second end 11 of the band 4 emerges from the bottom 6 of the tube 3. Further, in the preferred embodiment, the first end 10 of the band 4 is fastened to the bottom 13 of the first carabiner 1 and the second end 11 of the band 4 is fastened to the bottom 13 of the second carabiner 2. The first carabiner 1 may rest in either the first pair of notches 7 or the second pair of notches 8 depending on whether the first carabiner 1 is in the rigid or loose position. Additionally, in the preferred embodiment, the band 4 should be a length that is slightly longer than the tube 3 so that the band 4 is taut when the first end 10 and the second end 11 are stretched or twisted and the first carabiner 1 is placed in the first pair of notches 7. The tautness of the band 4 allows the first carabiner 1 to be in a static, rigid position making it easy to attach to an out-of-reach fixed anchor 14.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and rany modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A method for making a rock-climbing device comprising the steps of:

A. forming a rigid tube with a top and a bottom,

B. creating a band having an effective length with a first end and a second end made of a substantially taut material, C. forming said rigid tube with said top and said bottom further comprising the steps of:

1. creating a shaft,
2. cutting at least one first pair of notches into said top of said tube where said at least one first pair of notches are arranged at opposite ends from each other,
3. cutting a second pair of notches into said top of said tube where said second pair of notches are arranged at opposite ends from each other, D. inserting said band through said shaft in said rigid tube such that the first end of the band emerges from the top of said rigid tube and the second end of the band emerges from the bottom of said rigid tube, E. fastening a first carabiner to said first end of said band, F. fastening a second carabiner to said second end of said band.

2. The method of claim 1 further comprising the step of:

A. cutting said second pair of notches into said top of said tube at a depth greater than that of said at least one first pair of notches.

3. The method of claim 1 further comprising the step of:

A. cutting a third pair of notches into said bottom of said tube where said third pair of notches are arranged at opposite ends from each other.

4. The method of claim 1 further comprising the step of:

A. making the band out of nylon.

5. The method of claim 1 further comprising the step of:

A. making the rigid tube out of PVC plastic.

6. The method of claim 1 further comprising the step of:

A. making said carabiners out of aluminum.

7. The method claim 1 further comprising the step of:

A. making the band out of spectra.

8. The method of claim 1 further comprising the step of:

A. twisting said band in a radial direction such that the effective length of said band is shortened so that said first carabiner rigidly rests in said first pair of notches.

9. A rock-climbing device comprising:

A. a tube,

B. a first carabiner,

C. a second carabiner,

D. a band,

E. said tube further comprising:

1. a shaft,
2. a top, and
3. a bottom,
   i. said top further comprising:
      a. a first pair of notches arranged at opposite ends from each other,
      b. a second pair of notches arranged at opposite ends from each other, said second pair of notches being cut a depth greater than said first pair of notches, F. said band further comprising:

1. a first end, and
2. a second end,

G. said band passing through said shaft such that the first end of the band emerges from the top of said tube and the second end of the band emerges from the bottom of said tube, H. said first carabiner fastened to said first end of the band, I. said second carabiner fastened to said second end of the band.

10. the rock-climbing device of claim 9 wherein:

A. said bottom further comprises a third pair of notches arranged at opposite ends from each other.

11. A rock-climbing device comprising:

A. a tube,

B. a first carabiner,

C. a second carabiner,

D. a band,

E. said tube further comprising:

1. a shaft,
2. a top, and
3. a bottom,
   i. said top further comprising:
      a. a first pair of notches arranged at opposite ends from each other, b. a second pair of notches arranged at opposite ends from each other, said second pair of notches being cut a depth greater than said first pair of notches, ii. said bottom further comprising:

a. a third pair of notches arranged at opposite ends from each other,

F. said band further comprising:

4. a first end, and 5. a second end,

G. said band passing through said shaft such that the first end of the band emerges from the top of said tube and the second end of the band emerges from the bottom of said tube, H. said first carabiner fastened to said first end of the band, I. said second carabiner fastened to said second end of the band.

12. A rock-climbing device comprising:

A. tube,

B. a first carabiner,

C. a second carabiner,

D. a band having an effective length,

E. said tube further comprising:

1. a shaft, 2. a top, and 3. a bottom, i. said top further comprising:

a. a first pair of notches arranged at opposite ends from each other, b. a second pair of notches arranged at opposite ends from each other, said second pair of notches being cut a depth greater than said first pair of notches, ii. said bottom further comprising:

a. a third pair of notches arranged at opposite ends from each other,

F. said band further comprising:

1. a first end, and 2. a second end,

G. said first carabiner fastened to said first end of the band,

F. said second carabiner fastened to said second end of the band,

I. said band passing through said shaft such that the first end of the band emerges from the top of said tube and the second end of the band emerges from the bottom of said tube such that when said band is twisted in a radial direction the effective length of said band is shortened so that said first caribiner will be rigidly secured within said first pair of notches.

* * * * *